United States Patent [19]

Colma

[11] 4,021,976

[45] May 10, 1977

[54] PREFABRICATED STRUCTURES FOR BUILDINGS

[76] Inventor: Libero Colma, P.za Garibaldi 8, 20066 Melzo (Milan), Italy

[22] Filed: June 19, 1975

[21] Appl. No.: 588,471

[30] Foreign Application Priority Data

Feb. 11, 1975 Italy ..... 20144/75

[52] U.S. Cl. ..... 52/79.7; 52/234; 52/745

[51] Int. Cl.[2] ..... E04H 1/00

[58] Field of Search ..... 52/79, 234, 236, 745; 46/24

[56] References Cited

UNITED STATES PATENTS

| | | | |
|---|---|---|---|
| 3,488,900 | 1/1970 | Reid | 52/79 |
| 3,678,637 | 7/1972 | Klipfel | 52/79 |
| 3,724,143 | 4/1973 | Paukulis | 52/79 |
| 3,729,875 | 5/1973 | Felson | 52/79 |

*Primary Examiner*—J. Karl Bell
*Attorney, Agent, or Firm*—Michael J. Striker

[57] ABSTRACT

Prefabricated, modular structures, adapted for the erection of buildings in general, including a three-dimensional and a flat element which may be brought close to each other and such that the said three-dimensional element, having the shape of a rectangular trihedron consists of a slab of prolonged rectangular shape of convenient dimensions, from one of the shorter sides of which slab there extends a vertical wall of appropriate height, whereas from one of the longer sides of the same slab there extends a second vertical wall, brought close to one of the ends of the aforesaid wall, such second vertical wall having a lesser length than that of the slab so as to delimit on one side an opening.

4 Claims, 4 Drawing Figures

PREFABRICATED STRUCTURES FOR BUILDINGS

This invention relates to prefabricated, modular structures, adapted to be suitably coupled for the erection of buildings in general.

As is well known, the construction of dwelling houses or industrial buildings according to the traditional building methods results at present in excessively high production costs.

The prefabrication technique, introduced with a view to ensuring a better employment of labour is successful in minimizing the above-mentioned economical inconvenience, shortening considerably the construction times of a building.

It should be stressed here, however, that the building parts being at present made outside the job-site exclusively consist of more or less complicated flat structures.

Such flat structures, representing generally eventually equipped walls or slabs, require therefore particular arrangements during the erection stage, such as to ensure the squareness between the structures themselves.

It is a general object of this invention to provide prefabricated, modular structures, adapted to permit the erection of a building in the broadest meaning of the term.

More particularly, it is an object of this invention to provide distinct structures by the coupling of which it is possible to build the entire shell of a dwelling room.

It is a further object of this invention to provide prefabricated, three-dimensional structures so shaped as to allow a rational de-coupling or detachment thereof.

Such objects are in practice attained by utilizing flat structure and a structure shaped substantially like a rectangular trihedron, being suitably dimensioned.

Of the aforementioned structures the trihedron-shaped structure englobes a wall, part of one of the walls adjacent thereto, and a portion of the slab.

In particular, such slab portion has a width equal to that of the partial wall and a length greater than the main wall so as to define on the lower part the opening for a door or a window or for a window-door.

It should be noted that in view of its particular configuration, the same trihedron-shaped structure may be right-hand, ensuring in both cases the possibility of different side-by-side arrangements between the structures themselves.

The flat structure forms part of a slab and is so dimensioned as to be brought close to the slab portions being englobed in the aforesaid trihedron-shaped structures.

These and further characteristic features of a functional and constructional nature of prefabricated, modular structures according to the present invention and their different coupling possibilities will become more apparent from the following detailed description, taken in conjunction with the various figures on the accompanying drawings, in which.

Figure 1:
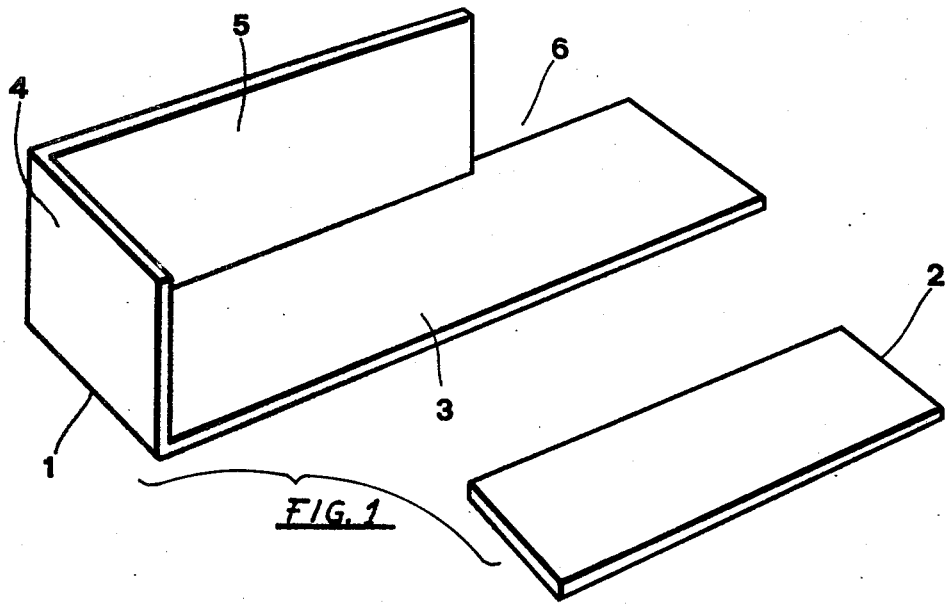
FIG. 1 shows the structures of this invention in a prespective view.

Referring now particularly to the reference numerals given in the figures on the accompanying drawings, the prefabricated, modular structure of this invention, adapted to permit the erection of buildings in general, includes a three-dimensional element 1 and a flat element 2.

More in detail, the three-dimensional element 1 consists of a slab 3 of a prolonged rectangular shape and conveniently predetermined dimensions.

From one of the shorter sides of the said slab 3 projects a vertical wall 4 of a height which is in conformity with the dwelling house building standards.

On one of the longer sides of the same slab 3 projects a second vertical wall 5, brought close to one of the ends of the aforesaid wall 4.

The said second wall 5 has in particular a conveniently shorter length than that of the slab 3 so as to delimit on one side an opening 6, designed to serves as a door or window.

It should be likewise noted that the said vertical walls may also be fully or partially provided with glass sheets, depending on the individual building requirements.

The flat element 2 has in turn a prolonged rectangular configuration with dimensions which are correlated to those of the aforementioned trihedron-shaped structure 1.

Figure 2:
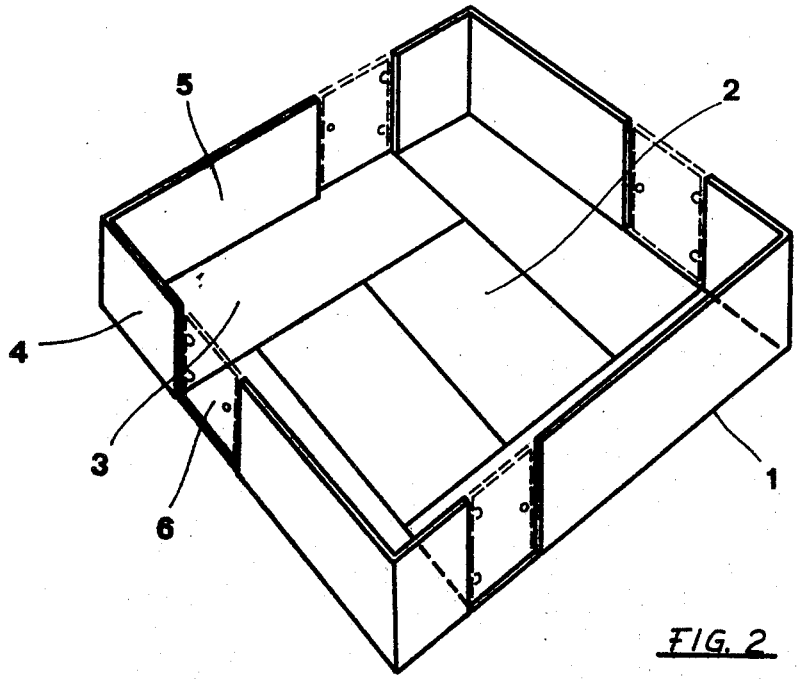
FIG. 2 represents one of the possible side-by-side arrangements on the same level of the structures.
Figure 3:
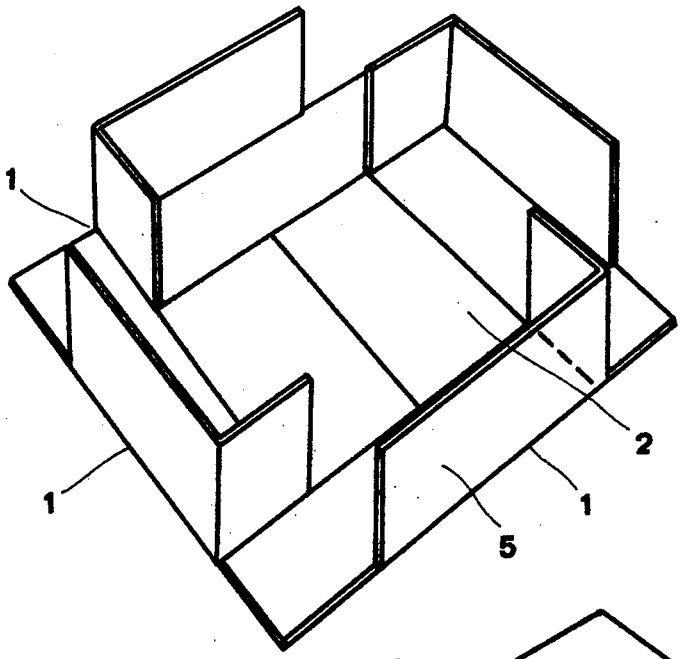
FIG. 3 is another possible side-by-side arrangement of the said structures.

Such structures 1 may in particular be disposed orthogonal to each other on a plane both in sequential (FIG. 2) and in alternate order (FIG. 3).

The inner surface, left free by the portions of the slab 3, is covered by a pair of flat structures 2.

In the case of FIG. 2 the opening 6 may receive doors or window-doors.

In the case depicted in FIG. 3 the same openings 6 may receive doors or windows.

The two types of dwelling rooms referred to above may be accomplished alternatively to each other depending on the different requirements involved and as a function of them, they are subsequently provided with adequate partition walls.

Figure 4:
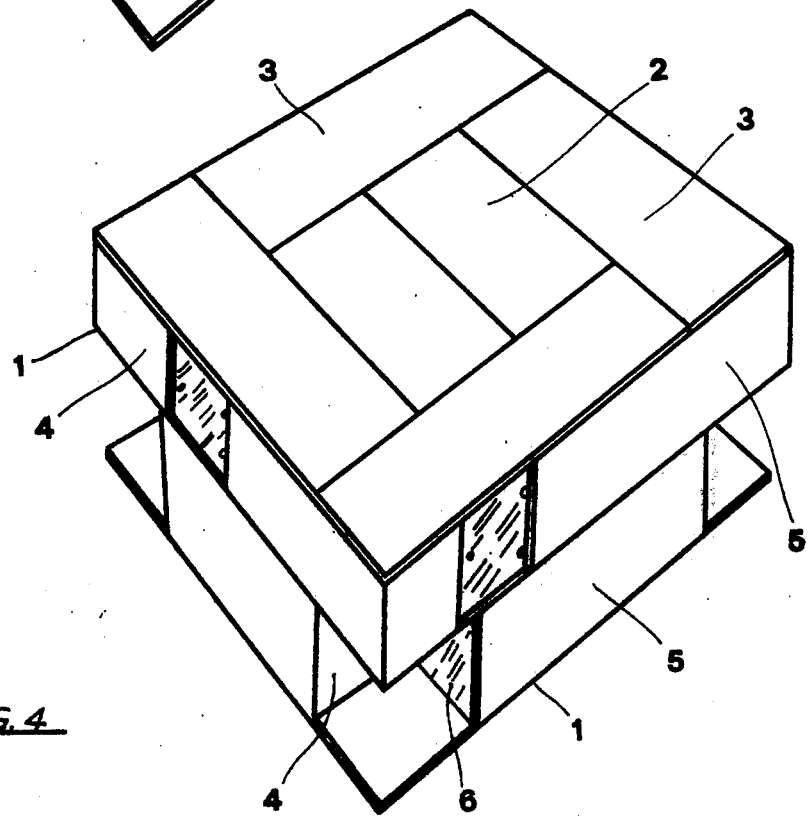
FIG. 4 represents two dwelling rooms built by the said side-by-side arrangements of the basic structures.

The covering of the same rooms (FIG. 4) is accomplished by a suitable side-by-side arrangement of portions of the slab 3 and the flat elements 2.

From the foregoing description and from perusal of the various figures on the accompanying drawings, it is possible to easily see the advantageous functional character and practical application of the prefabricated, modular structures according to the present invention.

I claim:

1. A building, comprising a plurality of substantially identical three-dimensional trihedron-shaped prefabricated modular elements each having an elongated rectangular slab, a first wall projecting upwardly from one narrow side of said slab and a second wall projecting upwardly from one long side of said slab and having a free end portion extending from said first wall towards but short of the other narrow side of said slab, said three-dimensional elements being disposed in a plane orthogonal to each other and together bounding an interior building space, each of said free end portions defining with a wall of the other element a gap serving for the installation of doors and/or windows; and means bridging said three-dimensional elements, being located in said plane and covering the area of said building space which is left free by said three-dimensional elements.

2. A building as defined in claim 1, wherein said three-dimensional elements are arranged in sequential order with reference to one another.

3. A building as defined in claim 1, wherein said three-dimensional elements are arranged in alternate order relative to each other.

4. A building, comprising a plurality of substantially identical three-dimensional trihedron-shaped prefabricated modular elements each having an elongated rectangular slab, a first wall projecting upwardly from one narrow side of said slab and a second wall projecting upwardly from one large side of said slab and having a free end portion extending from said first wall towards but short of the other narrow side of said slab, said three-dimensional elements being arranged closely adjacent one another and together bounding an interior building space the floor, ceiling and side walls of which are at least partly formed by the cooperating walls and slabs of said three-dimensional elements, each of said free end portions defining with a wall of another of said elements a gap serving for the installation of doors and/or windows.

* * * * *